United States Patent [19]

Artz et al.

[11] 4,179,032

[45] Dec. 18, 1979

[54] METHODS OF AND APPARATUS FOR CONVEYING, ORIENTING, TESTING AND SORTING ARTICLES

[75] Inventors: Walter M. Artz, Wyomissing Spring; Charles R. Bauer, West Lawn; Paul W. Moyer, Wyomissing, all of Pa.

[73] Assignee: Western Electric Co., Inc., New York, N.Y.

[21] Appl. No.: 941,899

[22] Filed: Sep. 11, 1978

[51] Int. Cl.[2] ..... B07C 5/02; B07C 5/344

[52] U.S. Cl. ..... 209/538; 209/545; 209/575; 209/698; 198/394

[58] Field of Search ..... 209/540, 545, 538, 575, 209/571-574, 701, 698; 198/394

[56] References Cited

U.S. PATENT DOCUMENTS

| | | | |
|---|---|---|---|
| 3,209,900 | 10/1965 | Hopkins | 209/81 |
| 3,478,860 | 11/1969 | Schick | 198/394 |
| 3,810,540 | 5/1974 | Georges | 209/73 |
| 4,054,814 | 10/1977 | Fegley et al. | 315/71 |

OTHER PUBLICATIONS

Abraham et al., *Technical Digest,* vol. 39, Western Electric Co., Inc., N. Y., Jul. 1975, pp. 1-2.

Avedissian, *Technical Digest,* No. 5, Western Electric Co., Inc., N. Y., Jan. 1967, pp. 11 and 12.

*Primary Examiner*—Allen N. Knowles

*Attorney, Agent, or Firm*—W. O. Schellin

[57] ABSTRACT

An article, such as a light-emitting diode, for replacing a slide base switchboard lamp has polar characteristics. The article has a light emitting cap located at one end and a cylindrical slide base with two contacts located diametrically across the base extending from the emitter. Handling the articles for testing their light intensity and hue characteristics involves orienting them. The articles are first oriented longitudinally in a vertical direction and to face the emitter all in the same direction. The articles are then conveyed in sequence to a test station. An eccentric force is applied to the base through friction between the moving articles and a stationary ledge. The applied force rotates the articles into one or the other of two oriented positions in which the contacts on the base become located in a plane perpendicular to the direction of their conveyance. A preliminary test determines which of the two positions have been assumed by each article. In testing for the light intensity and hue of each article, the direction in which a voltage is applied to its terminals is based on the outcome of the preliminary test. The articles are then sorted into acceptable ones and into rejects, based on the outcome of the light intensity and hue test.

10 Claims, 12 Drawing Figures

METHODS OF AND APPARATUS FOR CONVEYING, ORIENTING, TESTING AND SORTING ARTICLES

TECHNICAL FIELD

The present invention relates to methods and apparatus by which articles can be conveyed and oriented, so that a test may be performed on them. The outcome of the test is used to sort the devices into different groups. The invention is particularly applicable to articles such as solid state replacements for slide base lamps.

BACKGROUND OF THE INVENTION

Indicator lamps, such as incandescent switchboard lamps, are used in telecommunication systems in great numbers. The cost of the lamps in relationship to their lifetime is a critical factor in the economical operation of such systems.

Efficient testing and sorting methods applied to mass produced articles can significantly lower the cost of such articles. In the recent past, solid state replacements for switchboard lamps have been developed. (See U.S. Pat. No. 4,054,814, assigned to the assignee of records.) These replacements desirably retain the characteristics of luminescence and hue of the switchboard lamps, but in addition they exhibit a longer lifetime than their incandescent counterparts. A higher cost of these replacements can, of course, offset the advantage of an increased lifetime over the conventional lamps. It is, therefore, desirable to minimize manual steps in the production of the replacements.

The prior art includes a testing and sorting process in which an operator loads the replacement devices or articles into a test socket. Before the articles are loaded into the socket, they are manually oriented in a certain direction which aligns electrical contacts of the articles always in the same direction with a test circuit. A test is then performed which indicates, among possible other feedbacks, whether the tested article exhibits the correct hue and brightness in response to an applied test voltage. Individual handling of each article in preparation for this test and a subsequent manual sorting operation is cumbersome and adds significantly to the cost of the articles.

Automatic testing is well known in various phases of production of solid state electronic articles. However, with respect to some electronic articles manual handling is necessary. Because of the peculiar size and shape of some articles, automatic handling has not become available for them.

In the past, light emitting diodes (LEDs) have already been handled automatically in a brightness and hue test. An apparatus for testing LEDs has, for example, been disclosed in B. C. Abraham et al., "Light Emitting Diode Test Apparatus," No. 39 *technical digest* (Western Electric, pub., July, 1975). The prior art apparatus shows a vibratory feeder bowl which is well known for handling small electronic articles. Articles fed from the bowl enter a vibratory track and are received, one by one, in one of a number of slots spaced around a rotary table. As the table is indexed fron position to position, a new article is loaded at each step, an already loaded article is tested and one or more tested articles are discharged into bins located at consecutive stations about the periphery of the table. The decision to discharge a certain one of the articles into one or another of the bins is based on the test. "Smart" test circuits to make such decisions are well known in the art.

In the diode test apparatus of the prior art, a problem of alignment of the article in the receiving slot of the table did not occur. The diodes to be tested had a two-leaded configuration similar to that of other electronic articles. And it is possible to apply a test voltage first in one direction, and then in the other. If a light output from the diode in either one of the two directions meets desired specification, the two-leaded device is acceptable.

However, the articles to be tested in accordance with the present invention are already marked as to their polarity. A mere indication of a functional article tested in one of two directions is insufficient to test for the acceptability of such an article.

Also the articles to be tested have a molded shape which does not correspond to the usual shapes of solid state articles. It is consequently desirable to orient articles such as solid state lamp replacements to align their contacts with contacts in a test apparatus.

It is further required to ascertain whether the light emitting chips within the articles are correctly oriented. Each article may only light up when a voltage is applied to the terminals of the article in a predetermined direction with respect to an external polarity marking on the article.

SUMMARY OF THE INVENTION

In accordance with this invention, a method of and apparatus for conveying and orienting applies to an article which has at least one end with a pair of intersecting planes terminating in a taper having an edge. The method comprises positioning the article for rotatable movement into an opening through a first plate. The opening terminates with a contacting element of a second plate. The contacting element is capable of frictionally engaging the outer portion of the edge of the taper. By moving the first plate relative to the second plate, the article is rotated in the opening to align one of the planes of the taper with the contacting element of the second plate.

In another aspect of the invention, the article has two electrical terminals and polar electrical characteristics there between. And testing the article for acceptable values of such characteristics includes orienting the article in an opening of a first plate in one of two possible directions. The article is then tested to determine its orientation. Thereafter the article is tested to determine its characteristics with respect to such orientation.

The invention and its various advantages will be best understood when the detailed description is read in conjunction with the appended drawing, briefly described as follows:

DETAILED DESCRIPTION

A Typical Article

Figure 1:
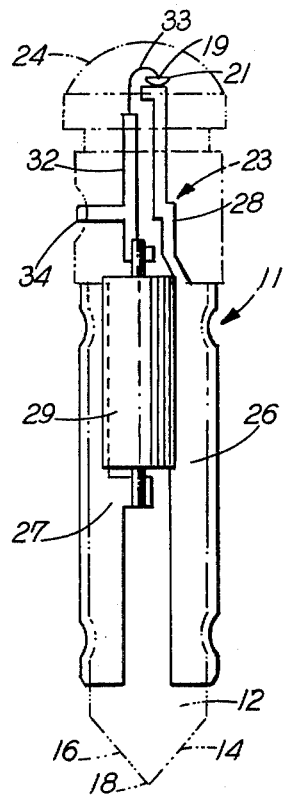
FIG.-1 (PRIOR ART)
FIG. 1 is a sectional view through a typical prior art article which can be oriented and tested by the methods and apparatus of this invention.

To aid in understanding the present invention, an article, such as a light-emitting diode, designated generally 11 (FIG. 1), will be described. The diode 11, which is described in U.S. Pat. No. 4,054,814 assigned to the assignee of record, is particularly well suited to be conveyed, oriented, tested and sorted by an apparatus which is further described as a preferred embodiment of the present invention. The diode 11 is a one-to-one solid state replacement for a slide-base type incandescent indicator lamp used, for example, in switchboards and key telephone units.

The diode 11 includes an elongated insulating base 12 with an end having at least a pair of intersecting planes 14 and 16 forming a taper having an edge 18. The diode 11 also includes a light-emitting diode chip 19 at the opposite end. The chip 19 is bonded within a reflector 21 which is advantageously part of a lead structure, designated generally 23. The chip 19 and the reflector 21 are housed in a transparent cap 24 bonded to the base 12. The cap 24 may be tinted to permit light of a desired hue to be emitted from the chip 19 when it is coupled into an electric circuit through the lead structure.

The lead structure 23 includes first and second elongated conductive contacts 26 and 27 which extend on the outside of the diode 11 laterally beyond the sides of the base 12. The contacts 26 and 27 terminate adjacent the tapered end, and each contact 26 and 27 lies in a plane perpendicular to and is associated with one of the planes 14 and 16 of the taper.

The first elongated contact 26 is electrically coupled to the chip 19 through an extension 28 of the lead structure 23. The second elongated contact 27 is electrically coupled to one terminal of a current limiting device 29, such as a voltage dropping resistor or diode.

The device 29 is selected to limit the current in view of the operating range of any source that might be connected to the elongated contacts 26 annd 27, and in this way not to subject the chip 19 to an excessive current to damage it. Such device 29 is not necessary if the voltage applied to the contacts 26 and 27 is sufficiently low so as not to subject the chip 19 to excessive current. A second terminal of the device 29 is coupled to a connecting link 32 of the structure 23. And a thin, conductive wire 33 is bonded to the exposed surface of the chip 19 and to the link 32, thereby completing an internal electrical connection between the contacts 26 and 27.

For manufacturing purposes, the link 32 has a termination 34 which projects from the base 12 on the same side of the article 11 as that on which the contact 27 is located. The projecting termination 34 is used as a visual polarity indicator of the diode 11. Contrary to incandescent lamps, the diode 11 has polar characteristics. Consequently, when the diode 11 is inserted into a switchboard lamps socket, the lamp has to be oriented for its positive terminal to be aligned with a positive supply terminal in the socket. The termination 33 identifies the contact 27 as the positive terminal of the diode 11.

The Apparatus in General

Figure 2:
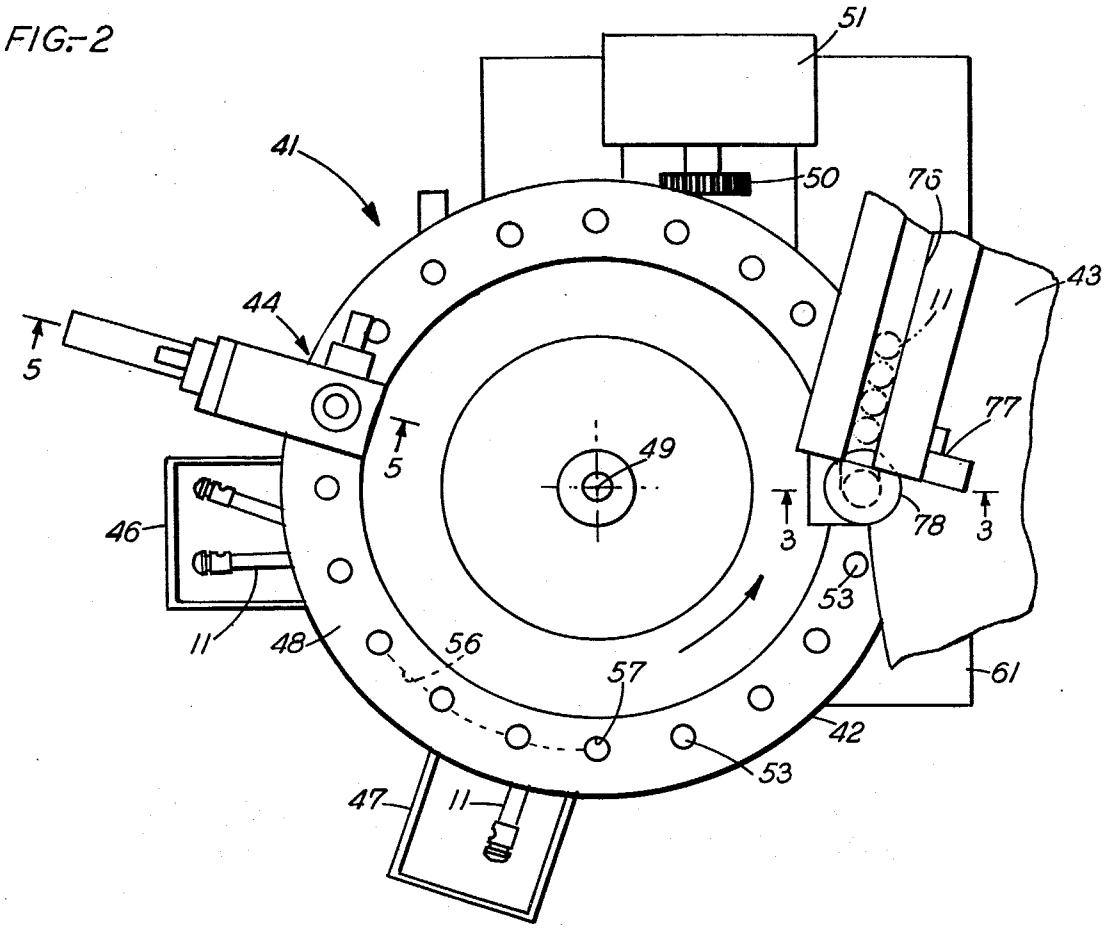
FIG. 2 shows a plan view of an apparatus which incorporates features of this invention.

Referring now to FIG. 2, an apparatus for conveying, orienting, testing and sorting a plurality of diodes 11 is shown. The apparatus, which is designated generally by the numeral 41, includes a rotary table 42. The table 42 receives the diodes 11 from a vibratory feeder 43 and advances them incrementally and in sequence past a test station 44 to one of at least two receiving bins 46 and 47.

Depending on the outcome of a test at the test station 44, the diodes are sorted into one or the other of the bins 46 and 47. Those of the tested diodes 11 which have met test requirements are sorted into the bin 46. Those of the tested diodes 11 which have not met the test requirements are further advanced to, and rejected into, the bin 47 as being rejects.

The rotary table 42 has a circular top plate 48 which is rotably mounted about a central vertical axis 49. A gear train 50, powered by a stepping motor 51 incrementally rotates the table 48 in a horizontal plane. Each time the motor 51 moves through a predetermined number of steps, the top plate 48 advances by one increment. In the preferred embodiment, an advance through 20 of such increments, completes one revolution of the top plate 48.

Figure 3A:
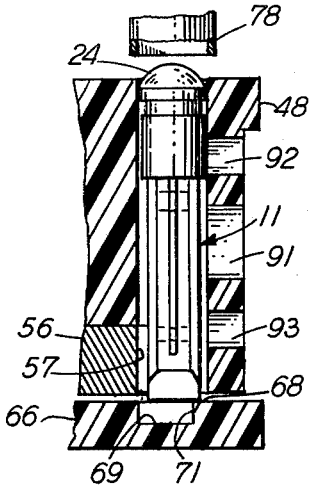
FIG. 3*a* is a partial sectional view of the apparatus shown in FIG. 2, the view showing the article inserted in a non-oriented position into an aperture in a turntable of the apparatus.
Figure 3B:
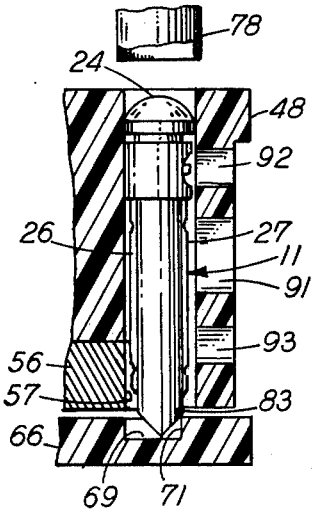
FIG. 3*b* is a partial sectional view of the apparatus similar to FIG. 3*a* except that the article is shown in an aligned position.

A plurality of apertures 53 in the top plate 48 are equally spaced just inside its outer periphery. The number of the apertures 53 correspond to the number of increments through which the top plate 48 advances in each revolution. The apertures 53 are slightly larger in diameter than the diodes 52 and extend vertically through the top plate 48. The walls of the apertures 53, therefore, guide the diodes 11, yet the diodes are free to slide vertically through the apertures 53 and also to rotate about their longitudinal axes. FIGS. 3*a* and 3*b* show a partial section through the apparatus for a better understanding of the top plate 48.

The top plate 48 is substantially of a synthetic resin material. The material is electrically insulating. Thus, within a recess in a lower portion of the top plate 48, a circular contact ring 56 of an electrically conducting material forms a radially inward facing segment 57 of the wall of each aperture 53. The ring 56 is concentrically located with respect to the axis 49. The apertures 53 extend into the periphery of the ring 56 for the material of the ring to form the segment 57 of the wall of each aperture 53.

Thus, if one of the diodes 11 is located within one of the apertures 53 and is oriented such that one of its contacts 26 or 27 faces the outer periphery of the ring 56 such contact establishes electrical continuity to the ring 56, particularly when the diode 11 is urged toward the center of the top plate 48.

A base 61 of the rotary table 42 supports the top plate 48, the motor 51 and also houses the gear train 50. The base 61 further supports a base plate 66 in a position horizontally adjacent to but spaced from the top plate 48. The base plate 66 is mounted rigidly to the base 61, to permit the top plate 48 to rotate relative to the base plate 66.

The base plate 66 extends past and blocks the lower openings of the apertures 53 except when the apertures 53 are located directly above each of the bins 46 and 47. In all other locations of the apertures 53 around the periphery of the top plate 44, the base plate 66 retains the diodes 11 within the apertures 53 once they have been inserted. Thus as the top plate 44 incrementally rotates, the end of the diode 11 having the intersecting planes 14 and 16 slides across the surface of the base plate 66. Along the sliding path of the diodes 11, a ledge 68 is formed in the base plate, preferably by a groove 69 which faces the top plate.

An outer wall 71 of the groove 69 is located outwardly offset from the path or hole circle which the centers of the apertures 53 traverse during the incremental rotation of the top plate 44. The ledge 68 consequently protrudes less than to the center of a circular projection of each aperture 53 onto the base plate 66. The ledge 68 performs a significant function in orienting the diodes 11 to align the contacts 26 and 27 at the test station 44.

Conveying and Orienting the Article

The vibratory feeder 43 is a commercially available well known mechanism for feeding small articles such as the diodes 11 to a desired handling mechanism. The diodes are fed from a common supply bowl in the center of the feeder along an inclined ledge into a track 76. The track 76 orient the diodes 11 into a vertical position in which the light-emitting or lens end of each diode faces upward.

The track 76 terminates in a conventional escapement mechanism 77 which selectively feeds one diode 11 after another in sequence through a vertical tube 78 toward the top plate 48. The incremental movement of the top plate 48 aligns one of the apertures 53 with the tube 78 each time the top plate 48 is indexed. The escapement mechanism is energized or operated in synchronism with the top plate 48 of the rotary table 42. After each indexing step of the top plate 48, one of the diodes 11 is fed by the escapement mechanism 77 to the tube 78. The diode 11 drops through the tube 78 into one of the apertures 53 which is at that time aligned with the tube 78.

In the track 76 itself, the diodes have become oriented and aligned in a row so that the cap 24 of each diode 11 faces upward and the base 12 with the end terminating in the edge 18 faces downward. This vertical orientation of the diode 11 is maintained as each diode drops into one of the apertures 53.

However, after the diodes 11 are guided into the apertures 53, they have to be oriented about their longitudinal axis. Such an orientation becomes necessary to align the contacts 26 and 27 so that an electrical connection can be made therewith at the test station 44. An interaction between the ledge the lower end of the diode 11 and the incrementally rotary motion of the top plate 48 accomplishes this final orientation.

Figure 4A:
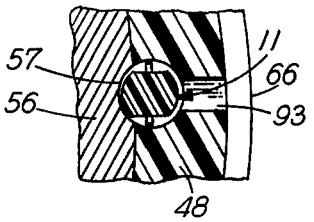
FIG. 4*a* is a partial sectional view of the apparatus of FIG. 3*a;*
Figure 4B:
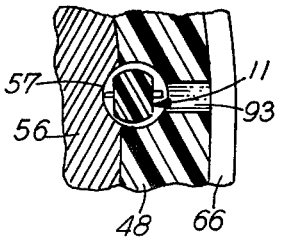
FIG. 4*b* is a partial sectional view of the apparatus of FIG. 3*b;*

Prior to such orientation about its longitudinal axis, the diode 11 comes to rest within the aperture 53 in a random orientation. This random orientation falls into one of two different groups of orientations which are illustrated best in FIGS. 3*a* and *b* and FIGS. 4*a* and *b*, respectively.

FIG. 3*a* shows the edge 18 of the diode being positioned substantially radially to the top plate 48. Since a radially outer portion of the edge 18 of the diode 11 rests on the ledge 68 of the base plate 66, the diode 11 is not fully inserted into the aperture 53. The cap 24 of the diode 11 still extends above the top surface of the top plate 48.

When the top plate 48 is indexed to advance the inserted diode 11 and to align a new aperture 53 with the tube 78, the ledge 68 remains stationary. Relative motion between the diode 11 in the aperture 53 and the ledge 68 results in a frictional force by the ledge 68 against the outer part of the edge 18. A torque on the inserted diode 11 rotates the diode about its longitudinal axis. The rotation continues as long as the ledge 68 remains in contact with the ledge 18. Ultimately the edge 18 slips off the ledge 68 and the diode therefore drops further through the aperture 71 of the groove bears against the radially outward facing one of the tapered planes 14 or 16. Contact between the plane 14 or 16 and the edge 83 stops the further insertion of the diode into the aperture 53.

This new orientation of the diode, in which the plane 14 or 16 rests against the edge 83, as shown in FIGS. 3*b* and in the plan view section 4*b*, is the second orientation which the inserted diode 11 can assume. In this second orientation, the contacts 26 and 27 of the diode 11 lie in a radial plane of the top plate 48. FIG. 3*b* shows the contact 26 resting substantially against the contact ring 56, however, the second orientation also includes a rotation of the diode 11 by 180 degrees, such that the contact ring 56 faces radially outward.

Of course, the diode 11 may be guided into the aperture 53 through the tube 78 with initially a second orientation in which the edge 18 does not come to rest on the ledge 68, and one of the planes 14 or 16 forming the taper immediately bears against the edge 83. The edge 83, in guiding the diode 11 to a position in which the diode becomes fully inserted into the aperture, performs a detenting function. In reaching the position of full insertion into the aperture 53, the diode 11 rotates until the edge 83 bears flatly against the plane 14 or 16. The detenting function of the edge 83 retains the diode 11 in this preferred position until the diode 11 is released from the aperture 53 after being tested.

From the above, it becomes apparent that an initial orientation of the diode 11 about its longitudinal axis in its respective aperture 53 is not critical. Independently of its intial orientation, each diode 11 ultimately achieves an alignment of its contacts 26 and 27 in a radial plane of the top plate 48. However, even in this final alignment position, the contacts 26 and 27 of the diode 11 may still face in one of two directions, each direction being 180 degrees apart from the other.

Testing the Article

Figure 5:
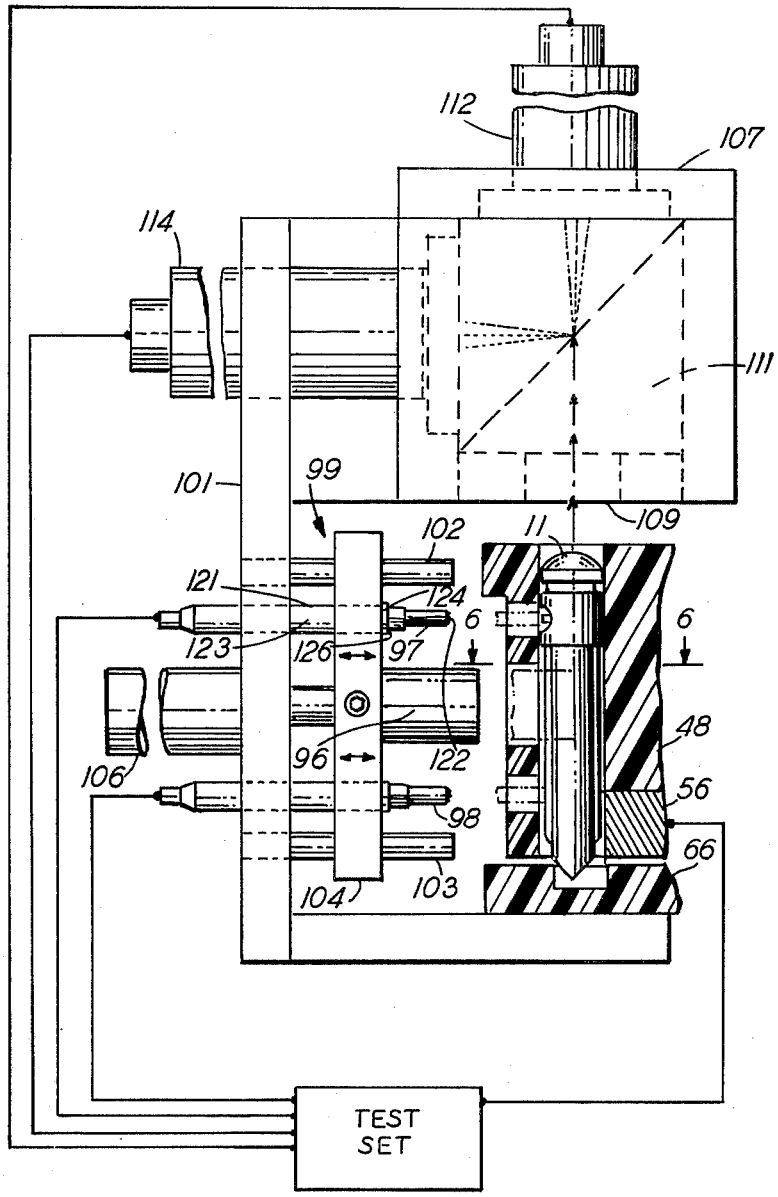
FIG. 5 is a partial and sectional side elevation of a test station in the apparatus of FIG. 2.

The test of the diodes 11 is best described in reference to the sectional view of the test station 44 in FIG. 5. The top plate 48 indexes the diodes 11, one after another, past the test station 44. Three lateral openings 91, 92 and 93 extend from the periphery of the top plate 48 to each of the apertures 53. The openings lie in the same radial plane as the aperture 53 to which they provide access.

The center opening 91 has a larger diameter than the upper opening 92 or the lower opening 93. The center opening provides access for a clamping pin 96, which urges the inner one of the contacts 26 and 27 of the diode against the contact ring 56. The upper and lower openings 92 and 93 admit an upper and a lower contact pin 97 and 98, respectively.

The clamping pin 96 and the upper and lower contact pins 97 and 98 are part of a horizontally moveable slide assembly 99. The slide assembly 99 is held in relationship to a frame 101 of the test station 44. Two vertically spaced dowel pins 102 and 103 extend horizontally from the frame 101 toward the top plate 48. A slide base 104 slides on, and is guided by, the dowel pins 102 and 103. The slide base 104 supports the clamping pin 96 and the upper and lower contact pins for movement toward and away from engagement with one of the diodes 11. The sliding movement of the slide base 104 is controlled by the actuation of an air cylinder 106. The cylinder 106 is mounted to the frame 101. And its movable piston drives the slide base 104 either toward the top plate 48 or away from it into a fully retracted position. In this retracted position, the clamping pin 96 and the contact pins 102 and 103 clear the top plate 48.

The frame 101 is rigidly supported by the base plate 66. A test cell 107 mounted to the upper portion of the frame 101 forms, together with the frame 101, a U-type structure. The structure cradles the outer edge of the top plate 48 and the slide assembly 99.

The test cell 107 includes a light-shielding enclosure 108. The enclosure 108 has an opening 109 which is located directly above, and facing, the aperture 53 when the aperture is located at the test station 44. When the diode 11 in the aperture 53 becomes energized, light emitted therefrom is directed through the opening 109 into the test cell 107. Within the test cell 107, the light enters a prism 111. The prism 111 splits the light into two outputs emanating at a substantially right angle to each other.

A first light output is directed to a light intensity sensor 112 which is located in the wall of the enclosure 108 opposite the opening 109. The intensity sensor (not shown) which, in response to a light input, transmits an electrical signal to a test set 113. The test set 113 is a conventional apparatus which has, however, been modified to control sorting of the diodes after they have been tested.

A second light output from the prism 111 is directed toward a hue detector 114 mounted at a substantially right angle to the direction of the incident light through the opening 109. The hue detector 114 also includes a photosensitive detector (not shown) which provides a signal in response to incident light. The hue detector 114 also has a filter 116 interposed into the light beam to selectively admit light of a desired hue and to filter out light of a different hue. The hue detector 114 recognizes, for instance, when diode 11 with a wrong lens cap reaches the station 44. The result of the hue test would then cause the diode 11 to be rejected, even though it had passed the brightness test.

Basically, each diode 11 is checked for two characteristics, e.g., its light intensity output in response to an applied voltage of known magnitude, and its hue. However, since the test is a functional test, it also implicitly checks whether the diode chip 19 is assembled with the correct orientation or polarity, or whether or not the current limiting device 29 has the correct value.

Figure 6:
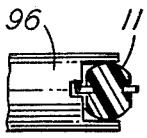
FIG. 6 shows a clamping pin at the test station shown in FIG. 5.

The voltage input to the diode 11 is chosen to correspond to the voltage which is applied to the diode 11 under normal operating conditions. The voltage is applied across the contacts 26 and 27 after the diode 11 has been advanced to the test station 44. Initially, the air cylinder is actuated to move the slide assembly 99 toward the aperture 53. The clamping pin 96 shown in FIG. 6 straddles the base of the diode 11 and pushes the contact 26 or 27 which faces the contact ring 56 into contact with the contact ring 56. The clamping pin 96 also holds the diode in fixed relationship to the upper and lower contact pins 97 and 98. The contact pins 97 and 98, also being mounted to the slide base 104, move into contact with the diode 11 substantially at the same time as the clamping pin 96 straddles the base of the diode.

The contact pins 97 and 98 are springloaded. An outer sleeve 121 of each pin 97 or 98 is fixedly attached to the slide base 104. A contact end 122 slides within the sleeve 121, and a spring 123 urges the contact end 122 so its foremost position in which it is normally held by shoulders 124 and 126 on the sleeve and the end. Thus, as the clamping pin 96 pushes the diode 11 against the contact ring 56 with the force developed by the air cylinder 106, the contact pins 97 and 98 move against the diode and become slightly unsealed from their shoulders. The ends 122 are thereby urged against the diode 11 by the force of the springs 123 in each of the pins 97 and 98.

The pin 97 contacts the diode 11 in the area along the length of the base 12 in which the termination 34 projects from the base 12. Since the diode 11 may be positioned in one of two directions, the termination 34 either faces the pin 97, or the termination 34 faces toward the center of the top plate 48. When the termination 34 faces the pin 97, the pin is urged into electrical contact with the termination 34. When the diode is positioned that the termination 34 faces toward the center of the top plate 48, the pin 97 is urged against the insulating housing of the diode 11 across from the termination 34.

The pin 98 moves into contact with one of the contacts 26 or 27 of the diode 11, depending on which way the diode 11 faces within the aperture 53. A preliminary test through the upper pin 97 and the lower pin 98 determines which way the diode 11 is positioned within the aperture 53. Thus, when an electrical continuity exists between the pins 97 and 98, the pin 97 has contacted the termination 34. In this position, the contact 27 faces and has been contacted by the contact pin 98.

However, when the diode is rotated by one-half turn about its longitudinal axis, the upper pin contacts the insulating material of the upper end of the base 12. Consequently, electrical continuity does not exist between the two pins through the diode 11 is an indication that the contact 26 has been contacted by the pin 98.

The polarity of the test voltage to be applied to the diode 11 is determined by this preliminary continuity test. depending on the orientation of the contacts 26 and 27 with respect to the lower pin 98 and the contact ring 56, the test set 113 internally switches a positive voltage to either the contact ring 56 or to the lower pin 98. The positive voltage is always applied to the terminal 27 of the diode 11. The resulting light output from the diode 11 is then analyzed by the light intensity sensor 112 and the hue detector 114. Test output signals are electrically compared to standards. The comparison yields a pass or fail decision in form of an electrical signal.

Sorting the Articles

The test set includes conventional circuitry for storing information, such as the signal, as to whether or not the diode 11 has passed or failed the test. As the top plate 48 incrementally advances and the apertures 53 move past the test station 44, they become positioned first above the bin 46, then above the bin 47 for accepting the rejects of the tested diodes 11.

Figure 7:
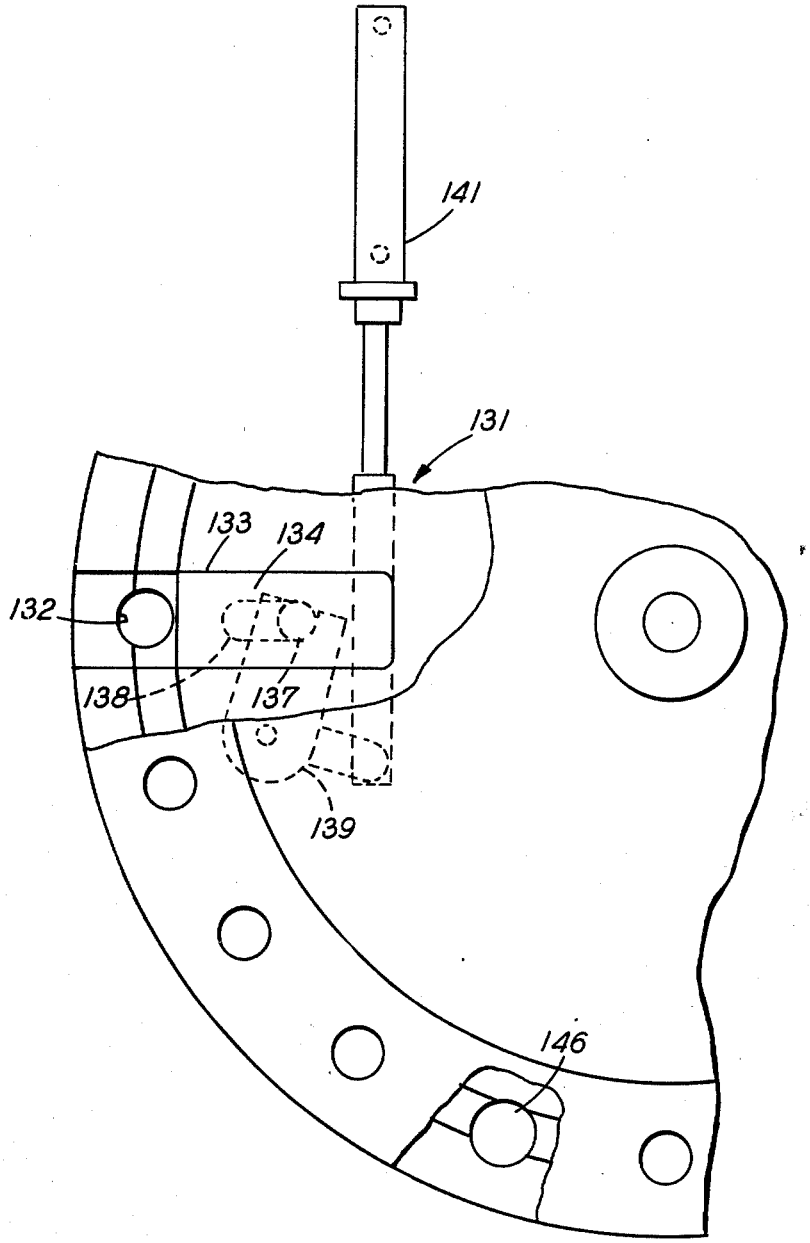
FIG. 7 is a partial plan view of the apparatus partially in section showing details of the sorting elements.

Referring to FIG. 7, a sorting mechanism 131 is mounted to the base plate 66 in a position above the bin 46. The base plate 66 has in this position, in alignment with a respective index position of the apertures 53, an opening 132. The opening 132 extends through the base plate 66. Thus, without having any blocking mechanism above the opening 132, the diode 11 drops through the opening 132 into the bin 46.

A recess 133 is machined into the base plate 66. The recess 133 guides a slide 134 between two positions, a normal or closed position and an energized or open position. In the closed position the slide 134 is located over the opening 132. An upper surface of the slide 134 is vertically positioned with respect to the edge of the diode 11 to support the edge of the diode 11 when it is not desired to drop the diode 11 through the opening 132.

A leading lateral edge 136 of the slide 134 may be leveled to guide the edge of the diode 11 onto the upper surface of the slide 134 without interference. Having been indexed past the slide 134, the base 19 of the diode 11 again is guided by the edge 83 of the groove 69.

Since the slide 134 normally covers the opening 132, any diode 11 is indexed past the bin 46. Consequently, without a positive input from the test set 113, the diode 11 is not classified as one having been accepted. This is considered to be a fail safe system, in that it takes an affirmative action by the sorting mechanism 131 to classify each diode 11 as having past the test.

The affirmative action is initiated by polling the stored signal on the decision from the test when the diode 11 has indexed to the opening 132. When the test signal shows acceptable light intensity and hue, the slide is moved to its open position. Temporary storing and later recall of test decision signals is well known in the art. Test apparatus employing such techniques is commerically available. A typical apparatus of the type for sorting articles according to their characteristics is described in U.S. Pat. No. 3,209,908 to S. W. Hopkins.

Typically, an electronic shift register (not shown) can be used to store information and to recall it after the information has been stepped through the register by a predetermined number of steps. The information signal is then used to selectively initiate action.

In the apparatus 41, the signal from the test set 113 determines whether or not to move the slide 134 to the open position when the diode 11 has been moved to a position above the opening 132. The slide 134 has a pin 137 depending through a slot 138 in the base plate 66. A bell crank 139, pivotally mounted to the base plate 66 and coupled to the pin 137, is used to redirect a selective actuation of the slide 134 by an actuator such as an air cylinder 141. It must be understood, however, that the use of air cylinders is a matter of choice. Electromagnetic actuators such as solenoids can also be used very conveniently in place of the air cylinders, particularly when a convenient low pressure air supply source is not available.

An affirmative signal from the test set 113 operates an electromechanically operated valve (not shown), which in turn operates the air cylinder 141. Its operation moves the slide 134 to its open position and the diode 11 drops through the opening 132. In the absence of the affirmative signal from the test set 113, the diode 11 moves during the following incremental movement of the top plate 48 to its next index position. A new aperture 53 moves at that time into alignment with the opening 132. The newly aligned opening 53 holds subsequently tested diode 11. Again, the presence of an affirmative signal from test set 113 will cause the diode 11 to drop through the opening 132 after the slide 134 has moved into the open position. After each such movement of the slide 134 and after the diode 11 has dropped into the bin 46, the slide 134 returns to its normal position. Thus each subsequent diode will be prevented from dropping into the bin 46, unless the affirmative signal from the test set indicates that such diode is, in fact, acceptable.

Without the affirmative signal actuating the slide 134, the diode 11 continues to be advanced to a position above the bin 47. In this position an opening 146 in the base plate 66 permits the diode 11 to slide through the base plate 66 and drop into the bin 47 to be classified as a reject, e.g., as not having met the test requirements.

Thus, to be sorted into the reject bin 47 no affirmative signal from the test set 113 is necessary. In the absence of an affirmative signal from the test set when the diode 11 has moved to the position above the opening 132, the diode 11 automatically becomes classified as a reject. This sorting method seeks to minimize the chance of a nonacceptable diode 11 from being sorted into the bin 46 of acceptable diodes in case an electrical malfunction would occur.

Any malfunction in the test set 113, or in its electronic support circuits, would tend to cause a diode to be rejected into the bin 47, rather than to cause one of the diodes 11 which should be rejected to be sorted into the bin 46.

Alternate Embodiments

Figure 8A:
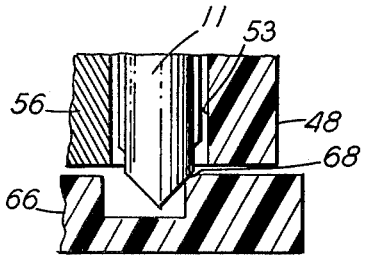
FIGS. 8*a* through 8*c* show alternate embodiments of an element which is used for orienting the article.
Figure 8B:
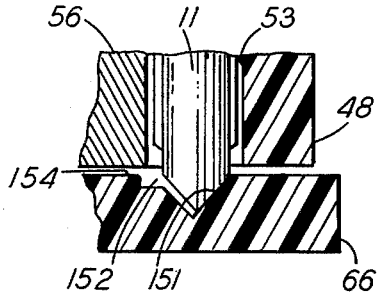
Figure 8C:
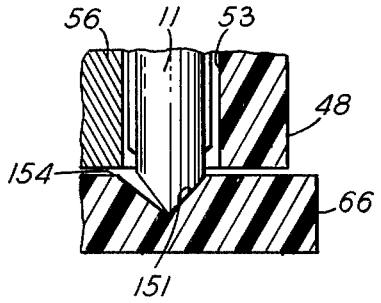

Of course, it is possible within the scope of this invention to make modifications to the described methods to the apparatus 41. FIGS. 8*a* through 8*c* show some of the variations in the structure of the groove 69 which are possible without altering substantially the function of the described preferred embodiment.

In FIG. 8*a*, the edge 83 has been rounded to present a smoother guide to the tapered surfaces 14 and 16 of the diode 11. The edge 83 will still align the contacting surface 14 or 16 parallel to itself. Consequently, the contacts 26 and 27 of the diode 11 still become oriented in a radially extending plane of the top plate 48.

In FIG. 8*b*, the groove 69 has been modified from an initially square cross section as shown in FIG. 3*a*, for example, to include a sloped surface 151. The slope of the surface 151 corresponds substantially to the slope of the tapered surfaces 14 or 16 when the diode 11 rests against the surface 151. The ledge 68 still performs the function of initially rotating the diode 11 about its longitudinal axis. Then the sloped surface 151 takes over the guiding and rotating of the diode 11 as the adjacent tapered surface, either 14 or 16, becomes more precisely aligned into a position substantially parallel to the surface 151 at the point where the diode 11 contacts the surface 151.

In FIG. 8*c*, an embodiment is shown, which is similar to the embodiment of FIG. 8*b*, except that a rectangular recess 152 of the cross section of the groove 69 in FIG. 8*b* is changed to a single sloped surface 153. In each embodiment it is important to avoid that the edge 18 of the diode 11 comes to rest on both the ledge 68 and on an opposite ledge 154. A balance of rotational forces on the edge 18 of the diode would then prevent the diode 11 from rotating about its longitudinal axis. Consequently, the alignment of the contacts 26 and 27 with the contact ring 56 and with the lower pin 98 would then be jeopardized.

Other embodiments with changes other than those discussed herein are, therefore, possible. Also, various other changes may be made without departing from the scope of this invention. For instance, it is possible to test the diodes 11 only for their intensity, or only for their hue.

The diode passing such a single test may then be sorted into the bin 67, and all other diodes 11 would be rejected. If the diodes 11 having passed the intensity test are then tested again for the correct hue, rejected diodes 11 would be acceptable but of a different hue. It is, therefore, possible within the scope of this invention to add one or more bins, such as the bins 67 and 68 to sort the diodes 11 into two or more groups of diodes 11 other than those which are rejected.

Other changes or substitutions are, of course, possible without departing from the scope and spirit of this invention.

What is claimed is:

1. A method of conveying and orienting an article having at least one end with at least a pair of intersecting planes terminating in a taper having an edge, which comprises the steps of:

positioning the article for rotatable movement into an opening in a first plate, the opening terminating with a contacting element of a second plate, said contacting element being capable of frictionally engaging the outer portion of the edge of the taper; and moving the first plate relative to the second plate to rotate the article in the opening to align one of the planes of the taper with the contacting element of the second plate.

2. The method of claim 1, wherein the first plate is rotatable, the second plate is fixed and the first plate is moved relative to the second plate by rotating the first plate.

3. The method of claim 1, wherein the article has a laterally projecting contact and the article is rotated so that such laterally projecting contact faces radially inward with respect to the first plate or radially outward with respect to such plate and electrical current is passed through the article in a first direction if the laterally projecting contact faces radially inward and in the opposite direction if the contact faces radially outward.

4. A method of conveying, orienting and testing an article having a cylindrical body and an end terminating in a diametrical edge perpendicular to its longitudinal axis, the article having characteristics ascertainable by contacting diametrically opposite body portions perpendicular to a plane defined by the edge and the longitudinal axis, the method comprising:

positioning the article for rotational movement about its longitudinal axis in an aperture of a moveable top plate;

retaining the article within the aperture by an abutting contact of a ledge against the end terminating in the diametrical edge, said ledge terminating in a contact edge parallel to a path for conveying the article, the longitudinal axis of the article being spaced from the ledge, said ledge and its contact edge making an eccentric contact with the end of the article;

conveying the article along the path relative to the ledge, thereby causing rotational friction on the article about its longitudinal axis during contact between the diametrical edge of the end of the article and the ledge;

rotating the article about its longitudinal axis with respect to its path while conveying the article for as long as said contact between said diametrical edge and said ledge continues;

detenting the diametrical edge of the end of the article into a position parallel to the contact edge; and contacting the diametrically opposite body portions in a direction perpendicular to the longitudinal axis of the article and perpendicular to the contact edge.

5. A method according to claim 4, wherein the article is detented into one of two possible positions, and the ascertainable characteristics are polar, the method further including performing a preliminary test to determine which of the two positions the article has been detented into, and wherein contacting the diametrically opposite body portions comprises contacting the body portions with test probes and applying a test through the test probes.

6. A method of conveying, orienting, testing, and sorting a plurality of light-emitting diodes, each diode having an elongated insulating base with an end having at least a pair of intersecting planes terminating in a taper having an edge, each diode also having a light-emitting diode chip at the opposite end and having a first and a second elongated conductive contact extending between the ends of and laterally beyond opposite sides of the base, the first elongated contact being electrically coupled to the chip while the second is electrically coupled to one terminal of a current-limiting device, each elongated contact being associated with one of the planes of the taper, each diode also having another laterally projecting contact electrically coupled to the chip and to the other terminal of the current-limiting device and being spaced from the second contact which comprises the steps of:

guiding each diode for rotatable movement into an opening in a rotatable first plate having a conductive ring contact partially exposed in the wall of that portion of the opening that faces radially inward, the opening terminating with a contacting element of a fixed second plate said contacting element being capable of frictionally engaging the outer portion of the edge of the taper;

rotating intermittently the first plate to incrementally move the diode to a test station while rotating intermittently such first plate relative to the second plate to rotate intermittently each diode in the opening to align one of the planes of the taper with a contacting element of second plate, such rotation of each diode resulting in the laterally projecting contact facing either radially inward or radially outward with respect to the first plate and resulting in one of the elongated contacts engaging the conductive ring contact exposed in the opening of the first plate;

engaging a pair of movable contacts with the diode during the dwell of the intermittent rotation of the first plate while the diode is at the test station, such engagement resulting in one of the movable contacts electrically engaging the other elongated contact of the diode while the other movable contact engages either the laterally projecting contact of the diode if such projecting contact is facing radially outward or engages the insulating base if the laterally projecting contact is facing radially inward, such engagement further resulting in the connection of a testing means to the diode to energize it with a voltage source of a first polarity of such other movable contact engages the laterally projecting contact and with a voltage source of the opposite polarity if such other movable contact engages the insulating base, such energization being capable of causing light to be emitted from the diode chip;

sensing the presence, intensity and color of any light emitted from the diode chip; and continuing to rotate intermittently the first plate to move intermittently each diode from the test station to a discharge station where diodes having chips with satisfactory light and color are deposited into a first location and diodes having unsatisfactory light and color are deposited into a second location, the diodes thereby being sorted in accordance with their light.

7. An apparatus for conveying and orienting an article having at least one end with at least a pair of intersecting planes terminating in a taper having an edge, which comprises:

means for positioning each article for rotatable movement into an opening in a first plate;

means, terminating the opening, for frictionally engaging the outer portion of the edge of the taper to the article; and means for moving the first plate relative to the second plate to rotate the article in the opening to align one of the planes of the taper with the contacting element of the second plate.

8. An apparatus for conveying, orienting and testing an article having a substantially cylindrical shape, terminating at one end in a diametrical edge perpendicular to its longitudinal axis and having polar characteristics ascertainable by contacting and applying a test through diametrically opposite body portions, the apparatus comprising:

means for receiving the article and for guiding it in a vertical position, free to rotate about its longitudinal axis;

means for contacting the article located along a diametrical plane through the receiving means;

means for retaining the article in the receiving means, said retaining means establishing eccentric frictional contact with the diametrical edge of the article upon the article being inserted into the receiving means in any other than one of two predetermined positions;

means for moving the retaining means relative to the receiving means, whereby the article is rotated about its longitudinal axis to assume one of the two predetermined positions;

means for aligning the article with the contact means; and means for testing the article coupled to the contact means.

9. An apparatus according to claim 8, wherein means for testing the article comprises:

means for determining which one of the two predetermined positions the article has assumed; and means for ascertaining the characteristics of the article.

10. An apparatus according to claim 9, which comprises means for detenting the article into one of the two predetermined positions.

* * * * *